US005359731A

United States Patent [19]

Cavalier

[11] Patent Number: 5,359,731

[45] Date of Patent: Nov. 1, 1994

[54] PROTECTIVE GARMENT

[76] Inventor: Earl J. Cavalier, 3890 Southdown Mandalay, Houma, La. 70360

[21] Appl. No.: 12,659

[22] Filed: Feb. 3, 1993

[51] Int. Cl.[5] ..... A41D 1/00; A41D 3/00; A41D 13/00

[52] U.S. Cl. ..... 2/46; 2/69; 2/79; 2/227

[58] Field of Search ..... 2/2, 46, 16, 59, 69, 2/69.5, 75, 79, 80, 82, 84, 87, 227, 231, 242, 22, 23, 24, 50, 51

[56] References Cited

U.S. PATENT DOCUMENTS

| | | | |
|---|---|---|---|
| 815,063 | 3/1906 | Brigham | 2/51 X |
| 897,445 | 9/1908 | Bartrum | 2/51 X |
| 2,715,226 | 8/1955 | Weiner | 2/87 X |
| 2,923,009 | 2/1960 | Cookman | 2/80 X |
| 3,023,419 | 3/1962 | Strahle | 2/80 X |
| 3,800,330 | 4/1974 | Boneut | 2/227 |
| 4,638,509 | 1/1987 | Charron | 2/79 X |
| 4,667,344 | 5/1987 | Cooper, III | 2/79 |
| 5,168,582 | 12/1992 | Aldridge | 2/79 X |

*Primary Examiner*—Jeanette E. Chapman
*Attorney, Agent, or Firm*—John F. Sieberth

[57] ABSTRACT

An outer protective garment resistant to water, snow, mud, etc., is described. It can be quickly and easily put on and taken off. Additionally, the garment can be put on over trousers, coveralls, etc., without removing one's shoes, boots or other footwear, thereby avoiding contaminating the interior of the trouser legs with mud or damaging the trouser legs by ripping them on boot buckles or the like.

16 Claims, 6 Drawing Sheets

PROTECTIVE GARMENT

FIELD OF INVENTION

This invention relates to an outer protective garment that the user can quickly and easily put on and take off. The invention further relates to a garment that is resistant to water, snow, mud, and the like. Additionally, this invention relates to a garment that can be put on over trousers, coverails, etc., without removing one's shoes, boots or other footwear.

BACKGROUND

Various designs for outer protective garments have been proposed heretofore. Some are bulky, heavy to carry, and/or uncomfortable to wear. Others are difficult to put on or take off. Many require removal of shoes, boots, galoshes, or the like, before stepping into the garment. In cases where it is possible to pull on the trouser legs of the protective garment over the shoes, boots, galoshes, or other footwear of the user, one often finds that mud, snow, or the like is transferred from the wearer's footwear to the interior of the trouser legs. Moreover, the trouser legs can become caught or ensnared by clasps or buckles on the exterior of the footwear and, as a consequence, be torn or otherwise damaged when pulling the trouser legs on over the footwear.

SUMMARY OF THE INVENTION

This invention provides a garment that does not suffer from the shortcomings referred to above. The garment can be folded into a compact shape that is easy to carry. It is light in weight and comfortable to wear. It is easy to put on and take off, and these operations can be conducted without need for removing footwear. Thus even though the user's footwear may be heavily laden with mud, slush, snow or the like, the interior of the trouser legs is not exposed to these materials, and damage to the trouser legs due to protruding buckles etc., on the footwear is avoided. And the garment is resistant to the ingress of water, snow, and mud.

In accordance with this invention, there is provided a garment which comprises at least outer trousers including a pair of leg portions contiguous with a torso section adapted to extend up to at least the waist of the wearer, as in a conventional pair of trousers. Each leg portion and contiguous torso section immediately thereabove has a seam extending along its the full length such that when worn by the user the seam extends from the bottom of the outer leg of the trouser upwardly along the outside of the leg, hip and waist to the upper end of the outer side of the torso section. Thus if the garment is configured in the form of outer protective trousers, the seams will extend from the lower outer edge of the trouser leg proximate to the outer ankle of the wearer up to the top of the waist at the wearer's side. On the other hand, if the garment is configured to resemble overalls where the torso section extends anywhere above the waist up to the wearer's armpits, the seams will extend from the lower outer edge of the trouser leg proximate to the outer ankle of the wearer up to the top of such torso section. In any such case, a slide fastener, preferably a zipper, is provided along each of the two respective seams and is oriented such that the seams are detachably secured together in closed position by actuating the slide fastener in a downward direction. Conversely, actuation of the slide fastener in the upward direction enables detachment along the seam.

The garment further comprises a pair of elongate flaps which are disposed respectively on the left and right sides of the garment. These flaps are either integral with or fixedly attached along one generally vertical edge onto the garment and are positioned and adapted to be detachably fastened along the other generally vertical edge onto the garment so as to conceal and cover the respective slide fasteners. Preferably, each flap extends the full length of the proximate seam, which the flap likewise covers when fastened in place. The garment is further provided with fastening means such as snap fasteners, hooks and eyelets, buttons and button holes, slide fasteners, intermeshing strips of Velcro-type connection means, or the like—preferably snap fasteners—so that each flap can be detachably secured in place over the proximate slide fastener and seam. The flap serves the dual role of providing protection against direct ingress of rain through the slide fastener, and of protecting the slide fastener against contact with mud or other debris that may clog the slide fastener and interfere with its proper operation. In a preferred embodiment, each flap is configured such that the forward portion of the flap is integral with the garment and the outer generally vertical edge of the flap is oriented to the rear when the flap is detachably secured in place to cover the proximate slide fastener and seam. In this way the flap is far less likely to become ensnared by foliage or the like as the wearer moves through underbrush or the like.

In a further preferred embodiment, the garment is further provided with a pair of shoulder straps which extend from the rearward portion of the torso section to the frontal portion of the torso section so that one strap is adapted to fit over one shoulder of the user and the other strap is adapted to fit over the other shoulder of the user. Most preferably, the upper frontal portion of the torso section is adapted to extend upwardly over the wearer's mid-section to about half way up the chest, and the shoulder straps are adapted to be detachably fastened to the upper frontal portion in proximity to its upper edge so as to keep the upper frontal portion in place over the wearer's body portions covered thereby. Not only does this construction provide protection over the wearer's body portions covered by upper frontal portion of the torso section, but additionally the fastening of the shoulder straps thereto eliminates need for a belt to keep the entire garment in place.

To put on the garment, the user straddles the garment, i.e., places the garment between the legs and pulls the garment upwardly so that the leg portions extend up to the wearer's crotch area. One slide fastener is then connected together and actuated downwardly, preferably just a short distance to secure one side of the garment in position around one outer side of the wearer's torso. Then this operation is repeated on the other side, whereby it is no longer necessary to grasp the garment to hold it in position for application. The slide fasteners are then actuated downwardly to their lower ends so that the leg portions are detachably fastened as outer trousers over and around the wearer's legs. Thereafter, the flaps are detachably secured in place over their respective seams and closed slide fasteners by use of the snaps or other fastening means provided for this purpose. At any suitable stage of this operation shoulder straps or waist belt means, if any, can be fastened in position. For example, if the garment is provided with shoulder straps, these may be secured in place over the shoulders of the wearer either before or after connecting the slide fasteners as described above.

Reversal of the foregoing procedure enables the wearer to remove the garment.

In another preferred embodiment of the invention the slide fasteners disposed along and adapted to close and unclose the seams of the garment do not extend to the lowermost portion of their respective seam in the leg portion. Instead, in this embodiment the slide fasteners terminate at a locus somewhere in the vicinity of the lower leg below the knee, such as approximately midway between the knee and the ankle. This keeps the slide fastener from coming in contact with the footwear of the user which may be wet with mud, snow, slush or the like.

In yet another preferred embodiment of this invention there is further provided a separate protective jacket, most preferably fabricated from the same material as the garment described above, which jacket can be worn over the above-described protective garment.

It will of course be understood and appreciated that the use in the present specification and claims of various directional terms such as "generally vertical", "upper", "lower", "bottom", "front", "rear", "up", "downwardly", etc., refer to the general directions existing when the user is wearing the garment and is in a standing position. Such terms are used to facilitate description and a clear understanding of the subject matter under discussion.

THE DRAWINGS

In the drawings, in which like numerals represent like parts among the several figures:

FIG. 1 is a front view of a preferred garment of this invention which includes shoulder straps detachably attachable to the upper portion of the front torso section.

FIG. 2 is a side view of the garment of FIG. 2. For ease of illustration, parts normally covered by the flaps (i.e., the seams, the slide fasteners and the lower loci of termination of the slide fasteners) are not shown in phantom in FIGS. 1 and 2. Only fold 45 (note FIG. 11) is shown in phantom in FIGS. 1 and 2.

FURTHER DESCRIPTION OF PREFERRED EMBODIMENTS

In the preferred form depicted, garment 10 is an outer trouser garment. It comprises a pair of leg portions 12*a* and 12*b* contiguous with torso section 14, and a pair of shoulder straps 18*a* and 18*b*. Torso section 14 has an upper frontal portion 16 which is adapted to extend upwardly over the wearer's mid-section to about half way up the chest. Shoulder straps 18*a* and 18*b* extend from the rearward portion of torso section 14 to upper frontal portion 16 so that one strap is adapted to fit over one shoulder of the user and the other strap is adapted to fit over the other shoulder of the user. Shoulder straps 18*a* and 18*b* are looped at their lower front portions so that they can be adjusted in length by means of slide fasteners 15*a* and 15*b*. As depicted, shoulder straps 18*a* and 18*b* are detachably secured to upper frontal portion 16 by means of fasteners 17*a* and 17*b*.

Seams 20*a* and 20*b* extend the full length of leg portions 12*a* and 12*b*, respectively, and in addition, extend generally vertically through the contiguous torso section 14 on either side immediately thereabove. Seams 20*a* and 20*b* each have a slide fastener 22*a* and 22*b*, preferably a zipper, oriented such that the seams are detachably secured together in closed position by actuating the slide fastener in a downward direction. Conversely, actuation of the slide fastener in the upward direction enables detachment along the seam. In the preferred form depicted and under present discussion, slide fasteners 22*a* and 22*b* terminate at loci 25*a* and 25*b* in the vicinity of the wearer's lower legs below the knee, such as approximately midway between the knee and the ankle.

Garment 10 further comprises a pair of elongate flaps 30*a* and 30*b* which are disposed respectively on the left and right sides of the garment. In the preferred form depicted, the forward portions of flaps 30*a* and 30*b* are integral with the garment and the rearward vertical portions 32*a* and 32*b* are positioned and adapted to overlie the proximate seam 20*a* or 20*b* and corresponding slide fastener 22*a* or 22*b* as the case may be. Flaps 30*a* and 30*b* in the preferred form depicted and under discussion are detachably fastened along and in proximity to the rearward vertical portions 32*a* and 32*b* of flaps 30*a* and 30*b* by means of a plurality of snap fasteners 35. In the preferred form depicted the exact disposition of fasteners 35 is not critical provided that fasteners 35 effect a generally vertical closure (i) to the rear of the respective generally vertical closure effected by slide fasteners 22*a* and 22*b*, and (ii) along a distance which corresponds to at least substantially the entire length of the respective generally vertical closure effected by slide fasteners 22*a* and 22*b*. In this way the closures effected by the respective slide fasteners is not only concealed and covered, but is protected against direct contact with rain, mud, underbrush, and the like.

Figure 11:
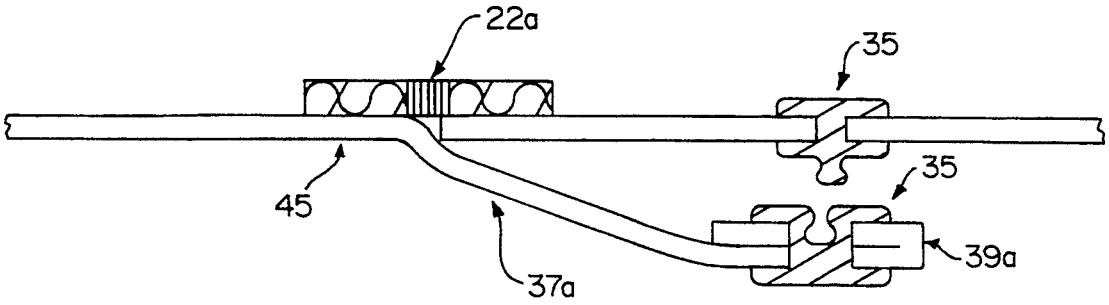
FIG. 11 is an enlarged fragmentary section illustrating a slide fastener in closed position but with a snap fastener shown in open position for the sake of clarity of illustration.

FIG. 11 further illustrates the cooperation among slide fasteners 22*a* and 22*b*, flaps 30*a* and 30*b*, and fasteners 35. As therein depicted, the outer forward portion 37*a* of flap 30*a* is integral with garment 10 and the outer edge 39*a* of flap 30*a* is oriented toward the rear of the wearer. The intermeshing portions of fastener 22*a* are shown in closed position, and the interacting parts of fastener 35 are shown in open position as they would be just prior to effecting their closure or just after effecting their separation. It can be seen from FIG. 11 that flap 30*a* conceals, covers and protects fastener 22*a* (and also the interacting portions of fastener 35) against direct contact with rain, snow, underbrush and the like. It will of course be understood that the same configuration of these parts would exist on the other leg portion of the garment except that the elements shown in FIG. 11 would be inverted so that the integral forward portion 37*b* of flap 30*b* is disposed to the outside of garment 10 and with the outer edge 39*b* of flap 30*b* oriented toward the rear of the wearer.

Figure 1:
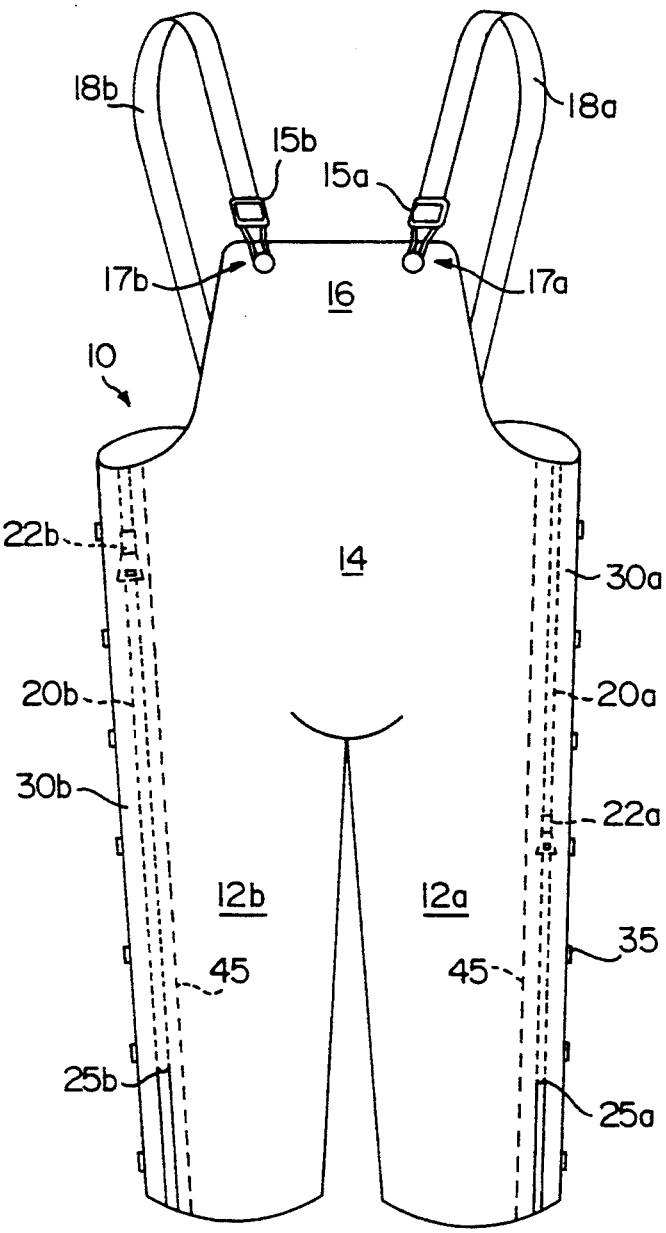
Figure 2:
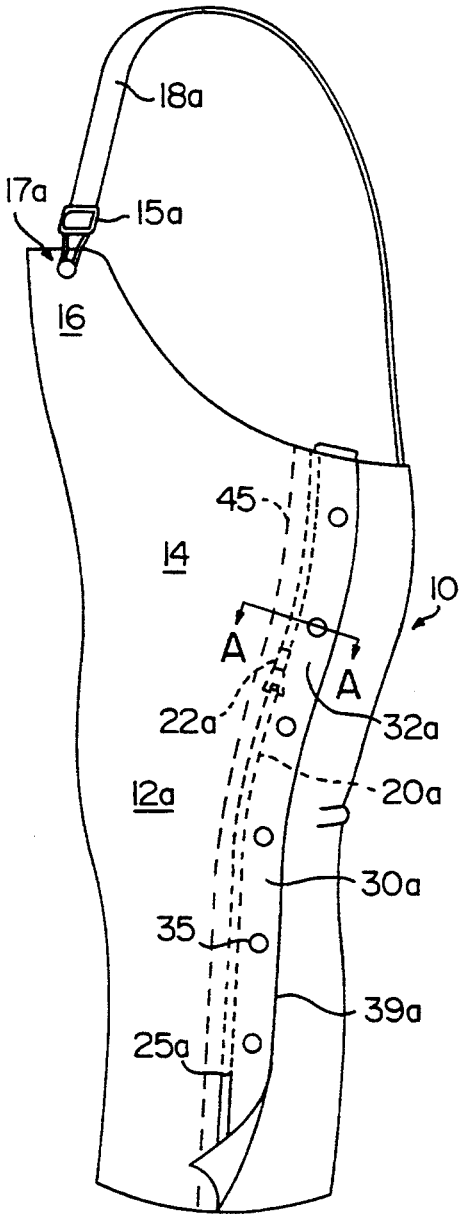
Figure 3:
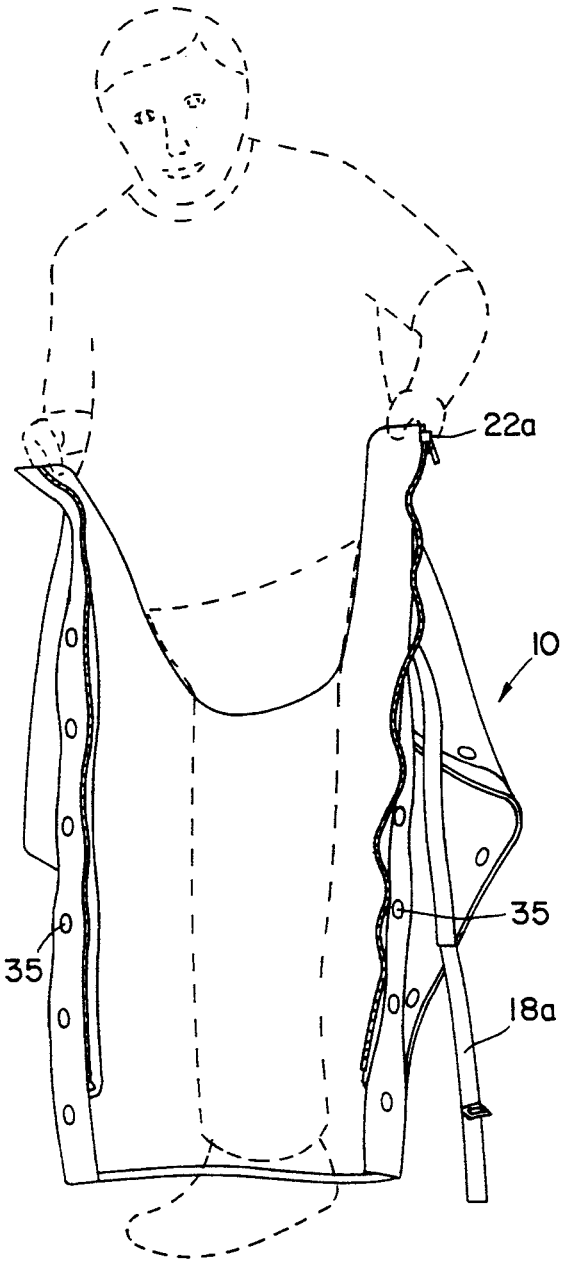
FIGS. 3 through 10 illustrate progressive stages of putting on a preferred garment of this invention.
Figure 4:
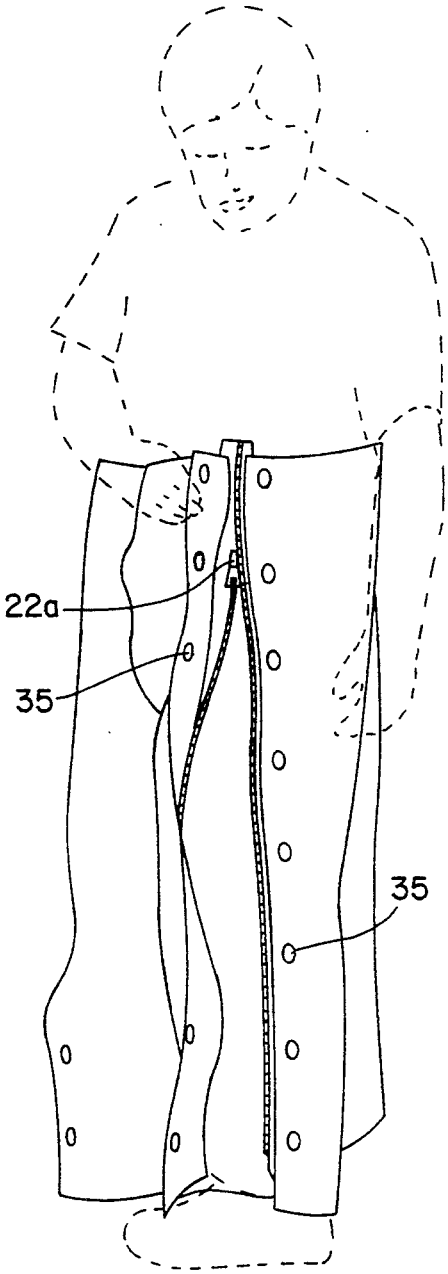
Figure 5:
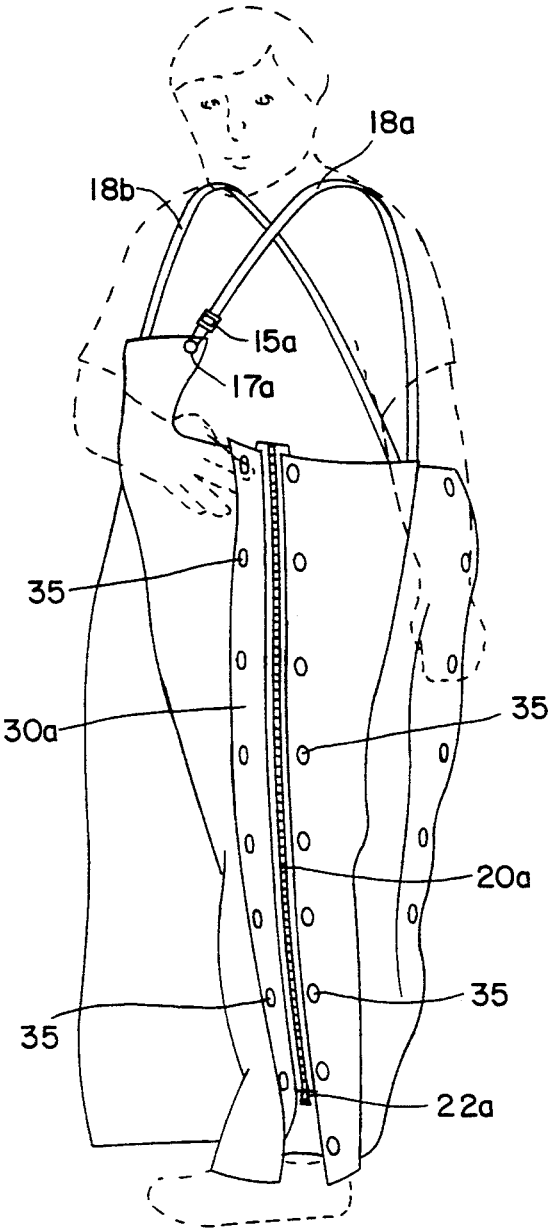
Figure 6:
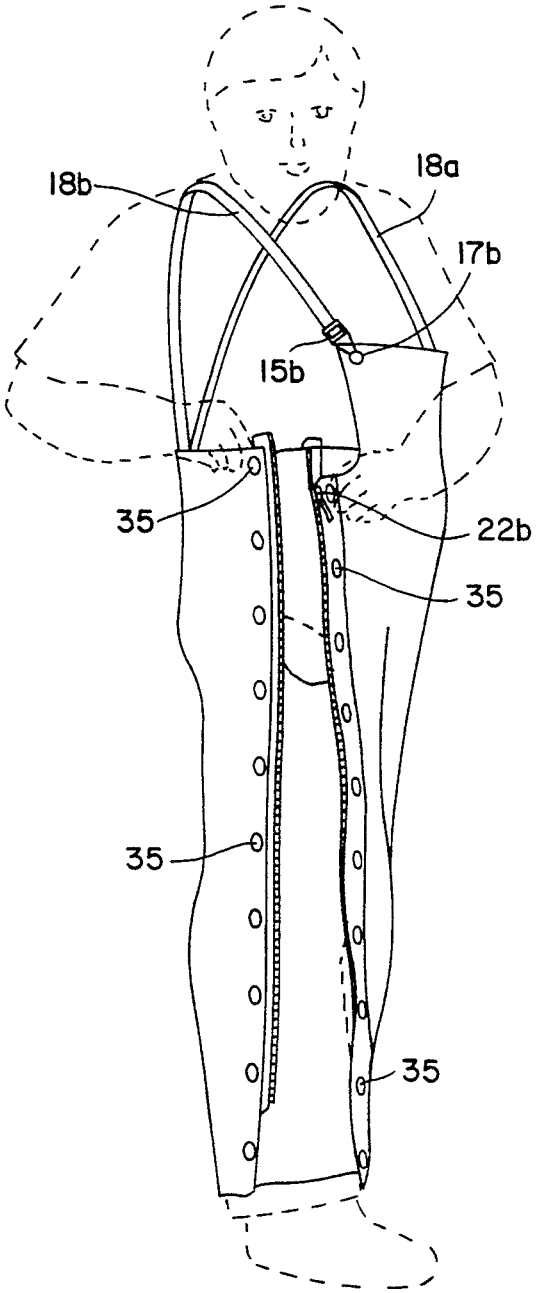
Figure 7:
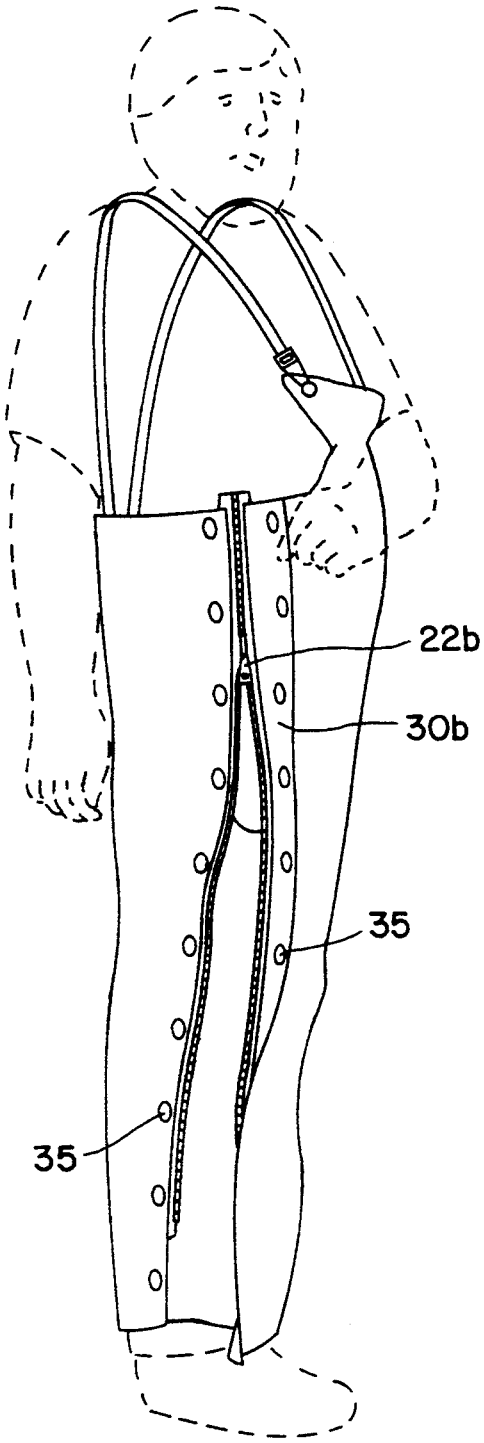
Figure 8:
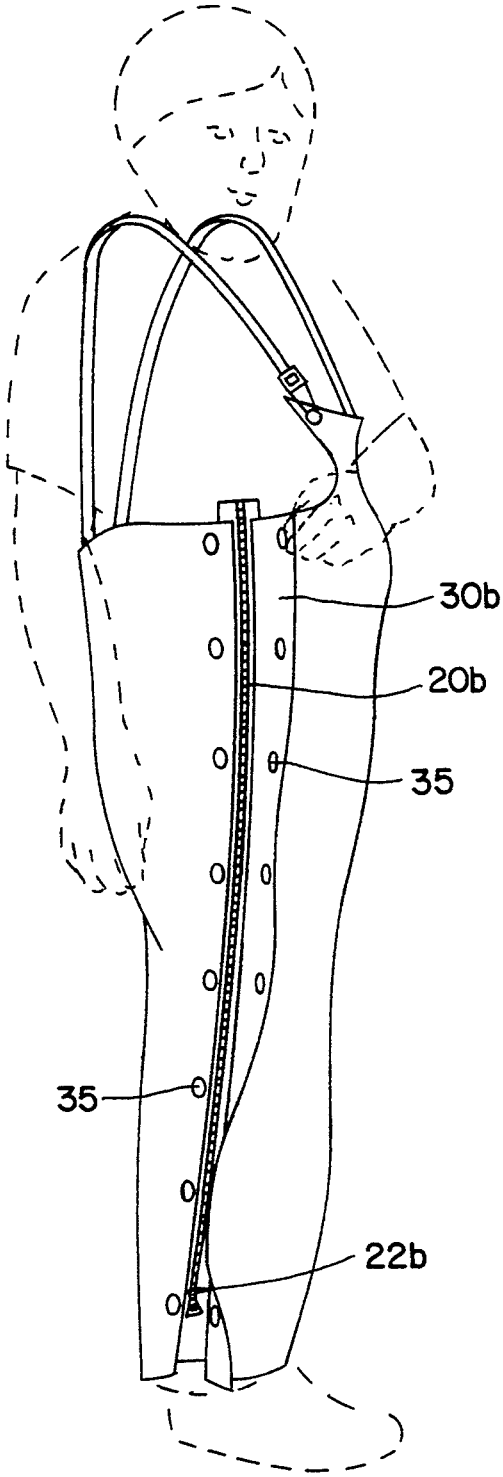
Figure 9:
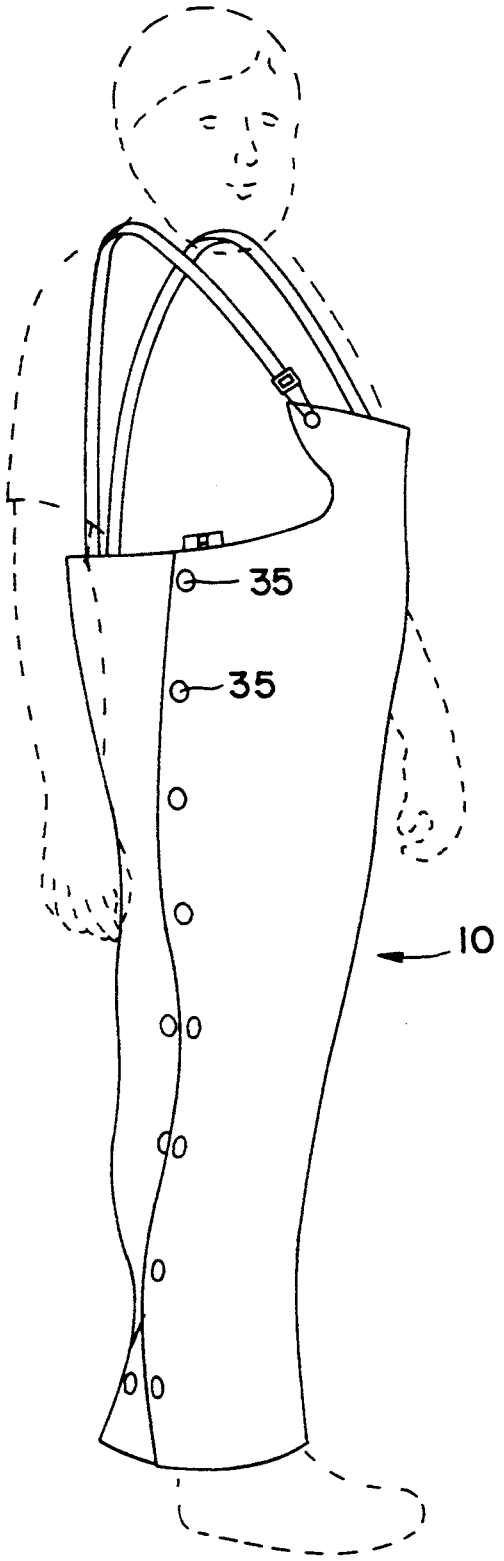
Figure 10:
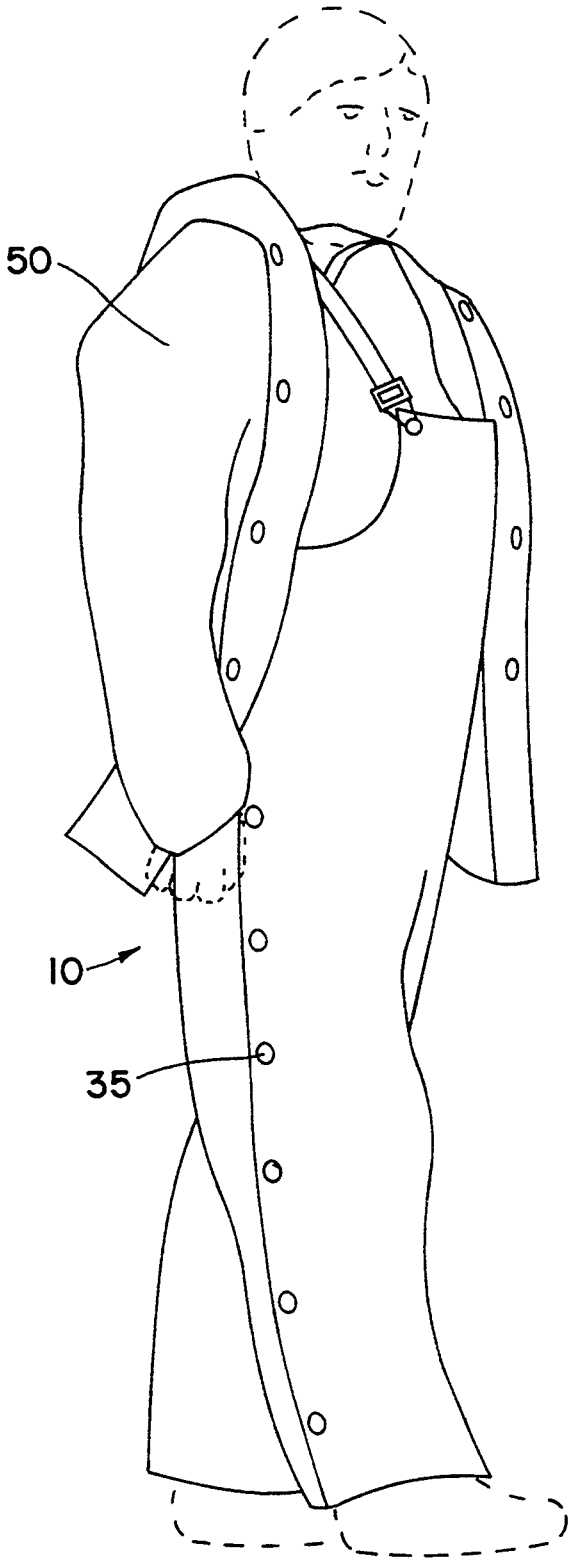

As depicted in FIG. 3, garment 10 is put on by straddling the garment with its slide fasteners 22*a* and 22*b* both unfastened. The shoulder straps 18*a* and 18*b* can then be fastened in place as shown in FIGS. 4 and 6, and then fastening slide fasteners 22*a* and 22*b* as depicted in FIGS. 4 through 8. Alternatively, slide fasteners 22*a* and 22*b* can be partially closed first on one side such as depicted for example in FIG. 4 and then partially closed on the other side such as depicted in FIGS. 6 and 7, before fastening the shoulder straps. In any event, slide fasteners 22*a* and 22*b* are thereafter actuated downwardly to effect the closures along their full lengths such as depicted in FIGS. 5 and 8. After securing one or both of the slide fasteners in this manner, the proximate flap 30*a* or 30*b* (as the case may be) is detachably secured over the proximate detachably secured seam and closed slide fastener by fastening the proximate set of snap fasteners 35 such as is shown in FIG. 9. Jacket 50, which may carry a hood for protecting the head of the wearer, can then be applied as is indicated by FIG. 10.

It will be seen from the Figures that not only is the garment of this invention readily put on, and thus equally readily taken off, but that the garment can be put on without removing boots or other footwear or stepping into and pulling on the leg portions of the garment in the conventional manner. It can also be seen from FIG. 10 that the slide fasteners and seams are well protected by the flaps once the snap fasteners have been secured.

The garment of this invention can be fabricated from any suitable fabric or materials conventionally used for fabricating rainwear, such as nylon, polyester, acrylics, polyolefins, cotton, wool, etc. Where necessary or appropriate the material or fabric can be subjected to processes that render the fabric water-resistant. If desired, the garment can be lined for extra protection against the elements, which lining material can be made integral with the garment or can be made as a separate liner which can be detachably secured to the garment. These and other variants will now be readily apparent to those skilled in the art of clothing design and manufacture.

This invention is susceptible to considerable variation in its practice. Thus this invention is not intended to be limited, and should not be limited, to the specific exemplifications presented hereinabove. Rather, what is intended to be covered hereby is the subject matter embraced within the spirit and scope of the appended claims and the full range of equivalents to which this invention is entitled as a matter of law.

What is claimed is:

1. A protective garment which comprises at least outer trousers sized to fit over and substantially encase a pair of regular long trousers worn by the user, said protective garment being characterized in that:

a) said protective garment includes a pair of leg portions contiguous with a torso section wherein said leg portions define a left leg portion having a lower end and a right leg portion having a lower end, and wherein said leg portions and contiguous torso section are sized such that when said protective garment is worn by the user over a pair of regular trousers (i) the lower end of said left leg portion terminates in proximity to the left ankle of the user, (ii) the lower end of said right leg portion terminates in proximity to the right ankle of the user, and (iii) the contiguous torso section extends up to at least the user's waist, said torso section having (iv) a left side terminating at an upper left end, (v) a right side terminating at an upper right end, (vi) a frontal portion disposed on said protective garment such that when said protective garment is worn by the user over a pair of regular trousers said frontal portion fits over at least a frontal portion of the torso of the user, and a rearward portion disposed on said protective garment such that when said protective garment is worn by the user over a pair of regular trousers said rearward portion fits over at least a rearward portion of the torso of the user;

b) said left leg portion and contiguous torso section immediately thereabove has a seam comprising a pair of edge portions which edge portions, by use of a left slide fastener referred to hereinafter, are (i) detachably connectable to each other and (ii) completely disconnectable from each other, said seam when detachably connected extending along the full length of the protective garment such that when said protective garment is worn by the user over a pair of regular trousers said detachably connected seam extends from the lower end of said left leg portion upwardly along the left outside of the user's left leg, left hip and left waist to the upper left end of the torso section;

c) said right leg portion and contiguous torso section immediately thereabove has a seam comprising a pair of edge portions which edge portions, by use of a right slide fastener referred to hereinafter, are (i) detachably connectable to each other and (ii) completely disconnectable from each other, said seam when detachably connected extending along the full length of the protective garment such that when said protective garment is worn by the user over a pair of regular trousers said detachably connected seam extends from the lower end of said right leg portion upwardly along the right outside of the user's right leg, right hip and right waist to the upper right end of the torso section;

d) said protective garment has said left slide fastener disposed along the seam of said left leg portion and contiguous torso section immediately thereabove, said left slide fastener being oriented such that (i) said seam can be detachably connected and secured together in closed position by connecting the slide fastener and actuating it in a downward direction, and (ii) said seam can be completely detached by actuating the slide fastener in the upward direction and disconnecting it;

e) said protective garment has said right slide fastener disposed along the seam of said right leg portion and contiguous torso section immediately thereabove, said right slide fastener being oriented such that (i) said seam can be detachably connected and secured together in closed position by connecting the slide fastener and actuating it in a downward direction, and (ii) said seam can be completely detached by actuating the slide fastener in the upward direction and disconnecting it;

f) said protective garment has (i) a left elongate flap which is aligned with and extends along substantially the entire length of the seam of said left leg portion and contiguous torso section immediately thereabove, and (ii) a right elongate flap which is aligned with and extends along substantially the entire length of the seam of said right leg portion and contiguous torso section immediately thereabove, said flaps each having a forward portion and a rearward portion terminating in an edge, the forward portion being on the side of the closed seam that is closer to the front of the user when said protective garment is worn by the user over a pair of regular trousers and the rearward portion being on the side of the closed seam that is closer to the back of the user when said protective garment is worn by the user over a pair of regular trousers, said left elongate flap being positioned on the protective garment to cover and conceal said left slide fastener and the seam when secured together in closed position thereby, and said right elongate flap being positioned on the protective garment to cover and conceal said right slide fastener and the seam when secured together in closed position thereby, said flaps being further characterized in that the respective front portions of said flaps are non-detachable whereas the rear edge portions of said flaps are detachably attachable onto said protective garment; and g) said protective garment further includes fastening means enabling each said flap to be detachably secured in place over the slide fastener and closed seam to be covered and concealed thereby.

2. A garment in accordance with claim 1 fabricated from water-resistant fabric or material.

3. A protective garment in accordance with claim 1 fabricated from water-resistant fabric or material.

4. A protective garment in accordance with claim 1 in combination with a separate jacket.

5. A protective garment in accordance with claim 1 in combination with a separate jacket wherein said garment and said jacket are both fabricated from the same water-resistant fabric or material.

6. A protective garment in accordance with claim 1 wherein said fastening means each comprises a plurality of snap fasteners disposed in substantially vertical alignment when said protective garment is worn by the user over a pair of regular trousers.

7. A protective garment in accordance with claim 1 wherein each said flap is configured such that the forward portion thereof is integral with the garment.

8. A protective garment in accordance with claim 1 wherein said garment further comprises a pair of shoulder straps which extend from the rearward portion of the torso section to the frontal portion of the torso section so that when said garment is worn by the user over a pair of regular trousers one strap is disposed and adapted to fit over one shoulder of the user and the other strap is disposed and adapted to fit over the other shoulder of the user.

9. A protective garment in accordance with claim 8 wherein said frontal portion of said torso section includes an upper frontal portion sized to extend upwardly over the user's mid-section to about half way up the user's chest when said protective garment is worn by the user over a pair of regular trousers, and wherein said shoulder straps are detachably fastenable to said upper frontal portion so as to keep the upper frontal portion in place over the user's body portions over which said upper frontal portion fits.

10. A protective garment in accordance with claim 1 wherein each said slide fastener terminates at a locus in the vicinity of the lower leg below the knee of the user when said protective garment is worn by the user over a pair of regular trousers, whereby a lowermost portion of the seam below said locus is not detachably connectable by the slide fastener.

11. A protective garment in accordance with claim 6 wherein each said slide fastener terminates at a locus in the vicinity of the lower leg below the knee of the user when said protective garment is worn by the user over a pair of regular trousers, whereby a lowermost portion of the seam below said locus is not detachably connectable by the slide fastener.

12. A protective garment in accordance with claim 7 wherein said fastening means each comprises a plurality of snap fasteners disposed in substantially vertical alignment when said protective garment is worn by the user over a pair of regular trousers.

13. A protective garment in accordance with claim 12 wherein each said slide fastener terminates at a locus in the vicinity of the lower leg below the knee of the user when said protective garment is worn by the user over a pair of regular trousers, whereby a lowermost portion of the seam below said locus is not detachably connectable by the slide fastener.

14. A protective garment in accordance with claim 9 wherein said fastening means each comprises a plurality of snap fasteners disposed in substantially vertical alignment when said protective garment is worn by the user over a pair of regular trousers.

15. A protective garment in accordance with claim 14 wherein each said slide fastener terminates at a locus in the vicinity of the lower leg below the knee of the user when said protective garment is worn by the user over a pair of regular trousers, whereby a lowermost portion of the seam below said locus is not detachably connectable by the slide fastener.

16. A protective garment in accordance with claim 15 wherein each said flap is configured such that the forward portion thereof is integral with the garment.

* * * * *